US009022398B1

(12) United States Patent
Harris et al.

(10) Patent No.: US 9,022,398 B1
(45) Date of Patent: May 5, 2015

(54) PADDLE SKATE

(71) Applicant: Hammerhead Boarding Products LLC, Virginia Beach, VA (US)

(72) Inventors: Scott G. Harris, Virginia Beach, VA (US); Terry L. Siviter, Virginia Beach, VA (US)

(73) Assignee: Hammerhead Boarding Products LLC, Virginia Beach, VA (US)

( * ) Notice: Subject to any disclaimer, the term of this patent is extended or adjusted under 35 U.S.C. 154(b) by 0 days.

(21) Appl. No.: 13/941,676

(22) Filed: Jul. 15, 2013

(51) Int. Cl.
*B62M 1/00* (2010.01)
*A63C 17/01* (2006.01)

(52) U.S. Cl.
CPC ..... *A63C 17/01* (2013.01)

(58) Field of Classification Search
USPC ..... 280/841, 11.19, 11.27, 845, 280/14.21–14.28
See application file for complete search history.

(56) References Cited

U.S. PATENT DOCUMENTS

| | | | | |
|---|---|---|---|---|
| D103,419 | S | 3/1937 | Birkhead | |
| D224,424 | S | 7/1972 | Schell | |
| D252,346 | S * | 7/1979 | Solheim | D21/765 |
| D257,536 | S | 11/1980 | Lukes | |
| D295,208 | S | 4/1988 | Vallejo | |
| D302,576 | S | 8/1989 | Woods | |
| 5,513,080 | A | 4/1996 | Magle | |
| D388,131 | S | 12/1997 | Snyder | |
| 5,915,707 | A | 6/1999 | Steffen | |
| 6,257,944 | B1 | 7/2001 | Herrod | |
| D483,087 | S | 12/2003 | Greenhalgh | |
| D629,859 | S | 12/2010 | Buksa | |
| D705,372 | S * | 5/2014 | Harris et al. | D21/765 |
| 2003/0155733 | A1 * | 8/2003 | Tan et al. | 280/87.042 |
| 2006/0217009 | A1 | 9/2006 | Burg | |
| 2008/0036165 | A1 * | 2/2008 | Reinson | 280/87.042 |
| 2009/0115152 | A1 | 5/2009 | Wilson | |
| 2011/0101664 | A1 | 5/2011 | Gonzalez et al. | |

FOREIGN PATENT DOCUMENTS

EP 1350543 A1 8/2003

OTHER PUBLICATIONS http://www.viewonline.com/pages/articles/loadedhammerhead.htm—Admitted Prior Art—Undated.
http://www.romesnowboards.com/boards/hammerhead/—Admitted Prior Art—Undated.
http://www.hamboards.com/hamboards—Admitted Prior Art—Undated.
http://www.viewonline.com/pages/articles/loadedhammerhead.htm.
http://www.romesnowboards.com/boards/hammerhead/.
http://www.hamboards.com/hamboards.

* cited by examiner

*Primary Examiner* — John Walters
*Assistant Examiner* — James Triggs
(74) *Attorney, Agent, or Firm* — Shaddock Law Group, PC

(57) ABSTRACT

A skateboard element that includes an elongate deck extending from a nose portion to a narrowed portion, and from the narrowed portion to a central portion, and from the central portion to a tail portion. The nose portion is a radiused nose portion that forms a convex curve and the narrowed portion is formed of two opposed recessed areas.

18 Claims, 7 Drawing Sheets

PADDLE SKATE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING

Compact Disc Appendix

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of skateboards and skateboard decks. More specifically, the present invention relates to a skateboard and/or skateboard deck that substantially mimics a stand up paddleboard.

2. Description of Related Art

Traditional paddleboarding is a water sport in which a paddleboarder typically lays or kneels on a paddleboard or surfboard and propels the board along the surface of the water using their arms or a paddle.

With the introduction of more buoyant paddleboards, traditional paddleboarding has evolved into stand up paddleboarding or stand up paddle surfing. In these variations, the paddleboarder stands atop the paddleboard and, while balancing atop the paddleboard, propels the paddleboard through the water using a paddle.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, since paddle boarding is a water sport, it can be difficult for someone to enjoy the sport in cold weather or during the cooler seasons of the year. Thus, all but the hardiest of paddleboarders generally enjoy a limited paddleboarding season.

The closest land-based alternative to paddle boarding is skateboarding. Unfortunately, while paddle boarding and skateboarding may seem very similar, they are quite different. Paddleboards are typically rather long and wide and allow a paddleboarder to stand atop the board with their feet centered below their hips, toes pointed forward (substantially in line with the longitudinal axis of the paddleboard), shoulder width apart.

Paddle boarders then use a paddle that is shaped somewhat like a canoe paddle to propel the paddleboard through the water.

Skateboards, on the other hand, are comparatively short and narrow. Skateboarders typically stand atop the skateboard with their feet substantially perpendicular to the longitudinal axis of the skateboard and the direction of travel. Propulsion of the skateboard typically involves using one foot to push off the surface of the ground, while maintaining the other foot atop the skateboard.

Thus, the present invention provides a paddle skate and/or paddle skate deck that substantially mimics a stand up paddleboard, thereby providing a ground-based alternative to stand up paddleboarding.

In various exemplary, non-limiting embodiments, the present invention, or paddle skate, comprises a skateboard element having an elongate deck that extends from a nose portion to a tail portion. A narrowed portion and a central portion are disposed between the nose portion and the tail portion. The nose portion is a radiused nose portion that is shaped so as to form a convex curve.

The deck of the paddle skate is substantially wider than the deck of a typical skateboard. This allows a user to stand on the deck of the paddle skate with their feet centered below their hips, toes pointed forward (substantially in line with the longitudinal axis of the paddleboard), shoulder width apart.

By design, a width of the radiused nose portion is greater than a width of an attached set of wheels. This is done so that the radiused nose portion will guide or force items, and, in particular, the associate paddle/pole away from the attached set of front wheels.

Skateboards, and particularly longboards, leave at least portions of the front wheels exposed. For purposes of skateboarding, this configuration does not typically present a problem because the skateboarder's feet (means of propulsion) are typically behind the front wheels, so there is no chance that the skateboarder's foot will come into contact with the front wheels. If a pole (used as a ground-based paddle) is used to propel a board having wheels with portions exposed to the front of the board, the paddle/pole can contact the front wheels, causing the wheels to stop abruptly, and potentially injuring the boarder.

Therefore, because the width of the radiused nose portion is greater than a width of an attached set of wheels, if the paddle/pole contacts any portion of the radiused nose portion, the radiused nose portion will force the paddle/pole away from the front wheels.

Again, in stark contrast to typical skateboards, a narrowed portion is disposed between the nose portion and the central portion of the paddle skate. The narrowed portion, which is formed of two opposed recessed areas, provides an area for the wheels to enter when an attached truck flexes, during turning of the paddle skate. In this manner, the front wheels do not contact a bottom of the paddle skate deck, even during extreme turning maneuvers.

In various exemplary, nonlimiting embodiments of the present invention, the paddle skate deck comprises an elongate deck extending from a nose portion to a narrowed portion, and from the narrowed portion to a central portion, and from the central portion to a tail portion. The nose portion is a radiused nose portion that forms a convex curve and the narrowed portion is formed of two opposed recessed areas.

In still other exemplary, nonlimiting embodiments of the present invention, the paddle skate comprises an elongate deck extending from a nose portion to a narrowed portion, and from the narrowed portion to a central portion, and from the central portion to a tail portion. The nose portion is a radiused nose portion that forms a convex curve and the narrowed portion is formed of two opposed recessed areas. A first truck is attached or coupled to a bottom of the deck at a first location and a second truck is attached to the bottom of the deck at a location spaced apart from the first location.

In certain embodiments, the first truck is attached or coupled to the bottom of the deck within the narrowed portion and the second truck is attached or coupled to the bottom of the deck within the tail portion.

Accordingly, the presently disclosed invention provides a paddle skate that allow a user to enjoy a form of a land-based stand up paddleboarding.

The presently disclosed invention separately provides a paddle skate with improved safety features, when compared to known skateboards.

The presently disclosed invention separately provides a paddle skate that is scalable.

The presently disclosed invention separately provides a paddle skate that can be easily maneuvered by a user.

These and other features and advantages of the presently disclosed paddle skate are described in or are apparent from the following detailed description of the exemplary, nonlimiting embodiments.

BRIEF DESCRIPTION OF THE SEVERAL VIEWS OF THE DRAWINGS

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

Figure 1:
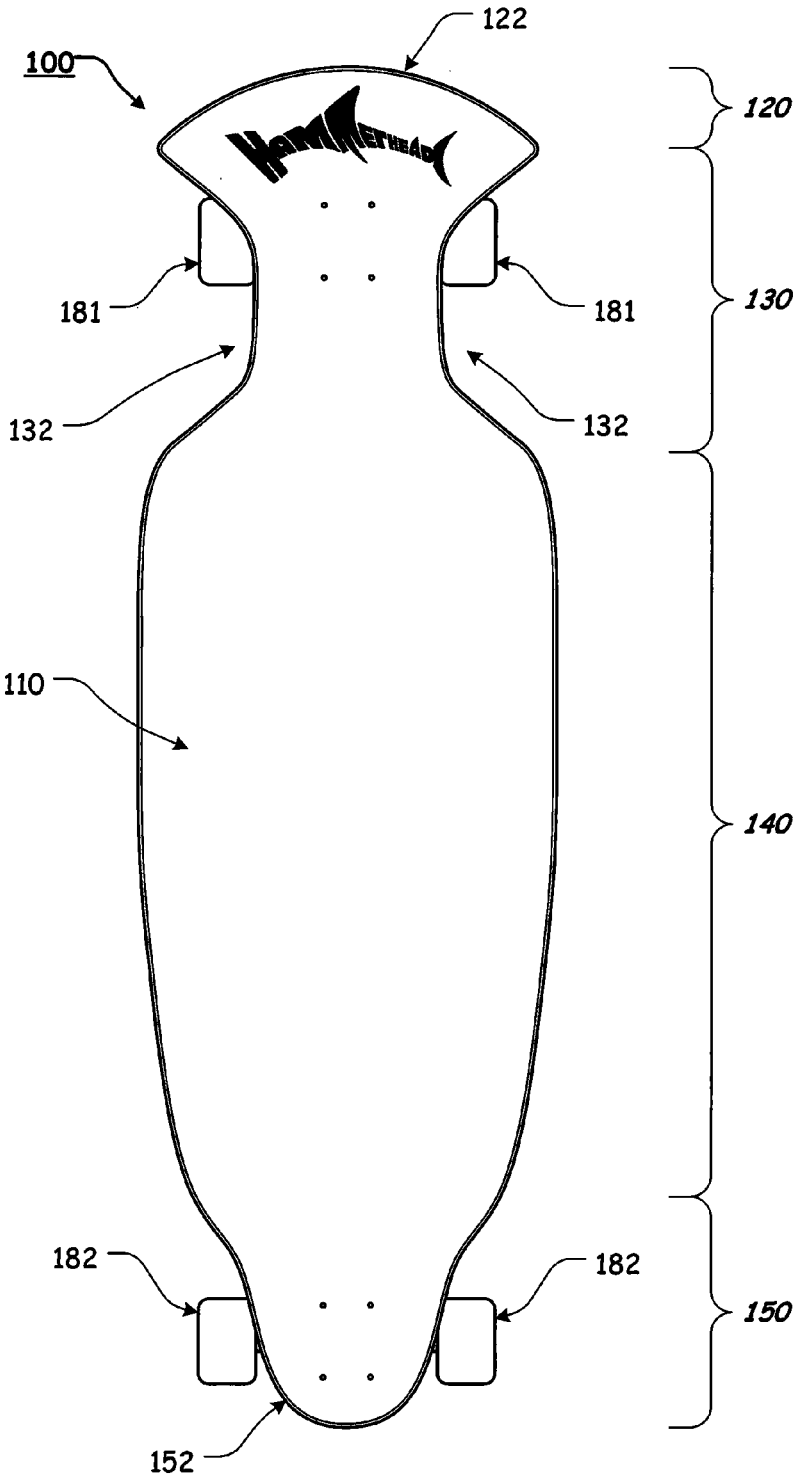
FIG. 1 shows a top view of a first exemplary embodiment of a paddle skate, according to this invention.
Figure 2:
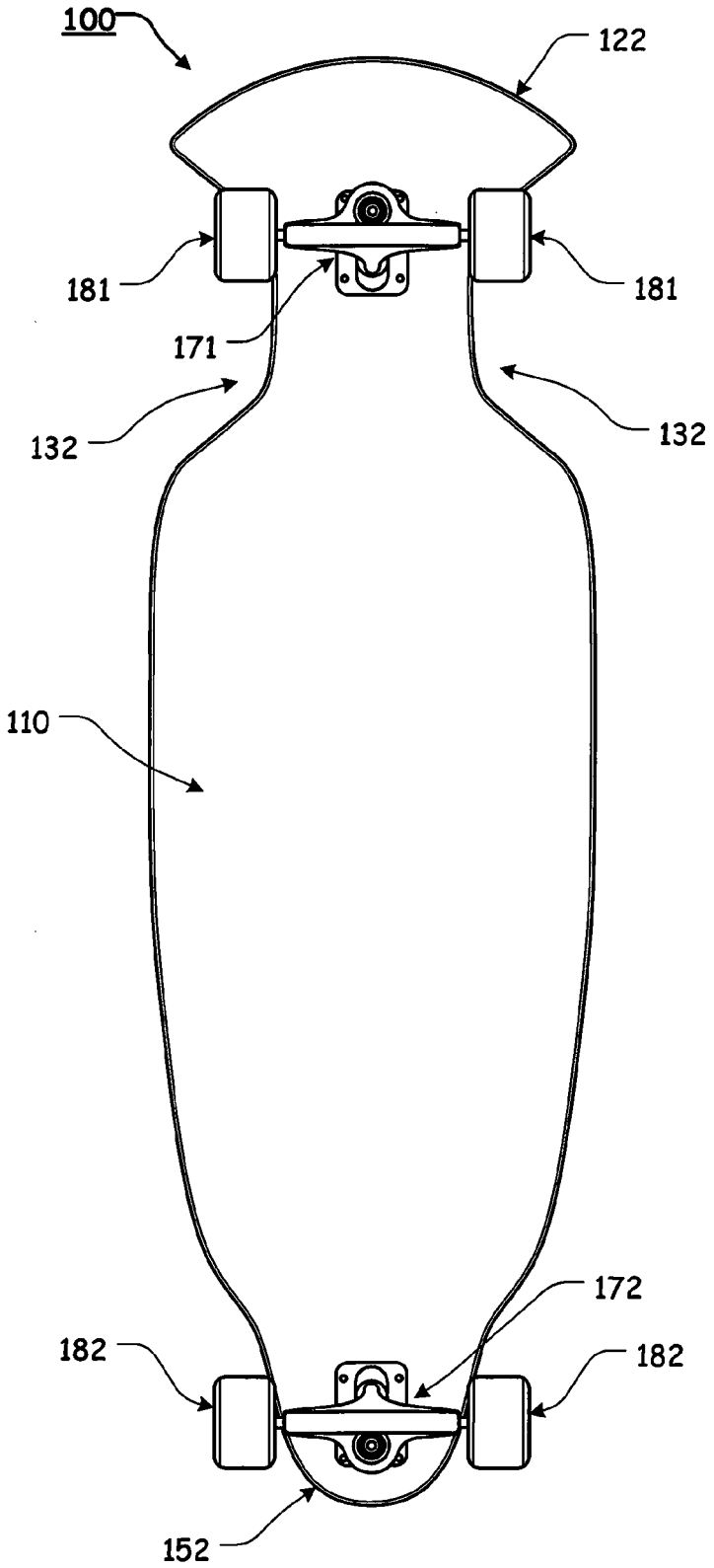
FIG. 2 shows a bottom view of an exemplary embodiment of a paddle skate, according to this invention.
Figure 3:
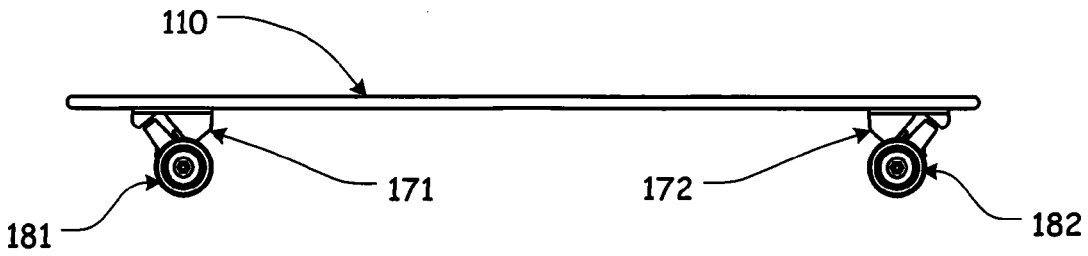
FIG. 3 shows a side view of certain elements of an exemplary embodiment of a paddle skate, according to this invention, it being understood that the right side of the paddle skate is a mirror image of the left side of the paddle skate.
Figure 4:
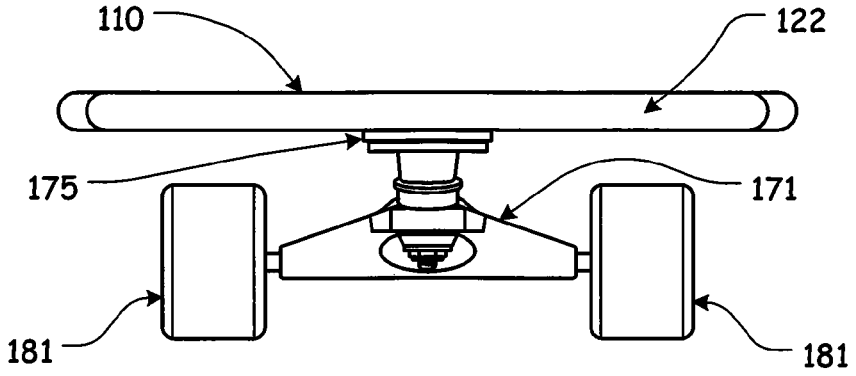
FIG. 4 shows a front view of an exemplary embodiment of a paddle skate, according to this invention.
Figure 5:
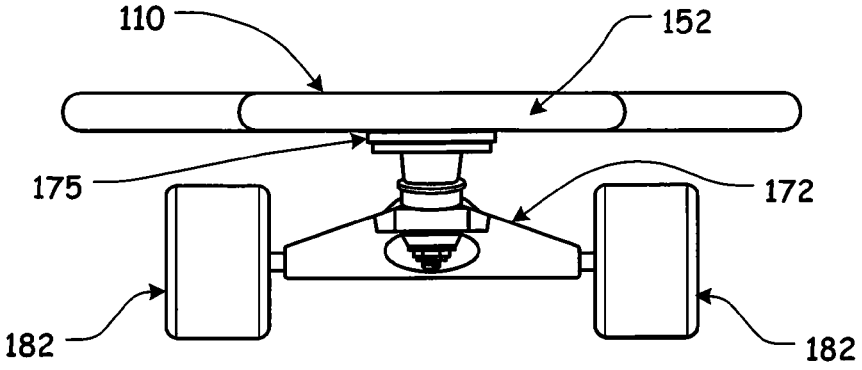
FIG. 5 shows a rear view of an exemplary embodiment of a paddle skate, according to this invention.

For simplicity and clarification, the design factors and operating principles of the paddle skate according to this invention are explained with reference to various exemplary embodiments of a paddle skate of this invention. The basic explanation of the design factors and operating principles of the paddle skate is applicable for the understanding, design, and operation of the paddle skate of this invention. It should be appreciated that the basic design factors and operating principles of the paddle skate can be adapted to any type of skateboard or skateboard deck.

It should also be appreciated that the terms "skateboard", "paddleboard", "paddle/pole", and "paddle skate" are used for basic explanation and understanding of the operation of the systems, methods, and apparatuses of this invention. Therefore, the terms "skateboard", "paddleboard", "paddle/pole", and "paddle skate" are not to be construed as limiting the systems, methods, and apparatuses of this invention. Thus, the term "paddle skate" is to be understood to broadly include any structures or devices embodying the features and elements of this invention.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Turning now to the drawing Figs., FIGS. 1-9 show certain elements and/or aspects of an exemplary embodiment of the paddle skate 100, according to this invention. In illustrative, non-limiting embodiment(s) of this invention, as illustrated in FIGS. 1-9, the paddle skate 100 comprise at least some of a skateboard element having an elongate deck 110 that extends from a nose portion 120 to a tail portion 150. A narrowed portion 130 and a central portion 140 are disposed between the nose portion 120 and the tail portion 150.

Therefore, in various exemplary, nonlimiting embodiments of the present invention, the paddle skate 100 comprises an elongate deck 110 extending from a nose portion 120 to a narrowed portion 130, and from the narrowed portion 130 to a central portion 140, and from the central portion 140 to a tail portion 150.

In various exemplary embodiments, the deck 110 comprises an elongate portion of material extending from the nose portion 120 to a tail portion 150 and having a longitudinal axis $A_L$.

In certain exemplary embodiments, the deck 110 is substantially rigid and is formed of wood, such as, for example, plywood. In certain exemplary embodiments, the deck 110 may be formed of plywood with a face veneer, specialty plywood, decorative plywood, waterproof plywood, water resistant plywood, or any appropriate type or thickness of plywood, having any desired number of plies. Alternate materials of construction of the deck 110 may include one or more of the following: wood, steel, stainless steel, aluminum, powder coated aluminum, marine grade aluminum, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the deck 110 is a design choice based on the desired appearance, strength, and/or functionality of the deck 110 and/or the paddle skate 100.

It should be appreciated that certain elements of the deck 110 and/or the paddle skate 100 may be formed as an integral unit (such as, for example, the nose portion 120, the tail portion 150, the narrowed portion 130, and the central portion 140). Alternatively, suitable materials can be used and sections or elements made independently and attached or coupled together, such as by adhesives, welding, screws, rivets, pins, or other fasteners, to form the various elements of the deck 110 and/or the paddle skate 100.

Figure 9:
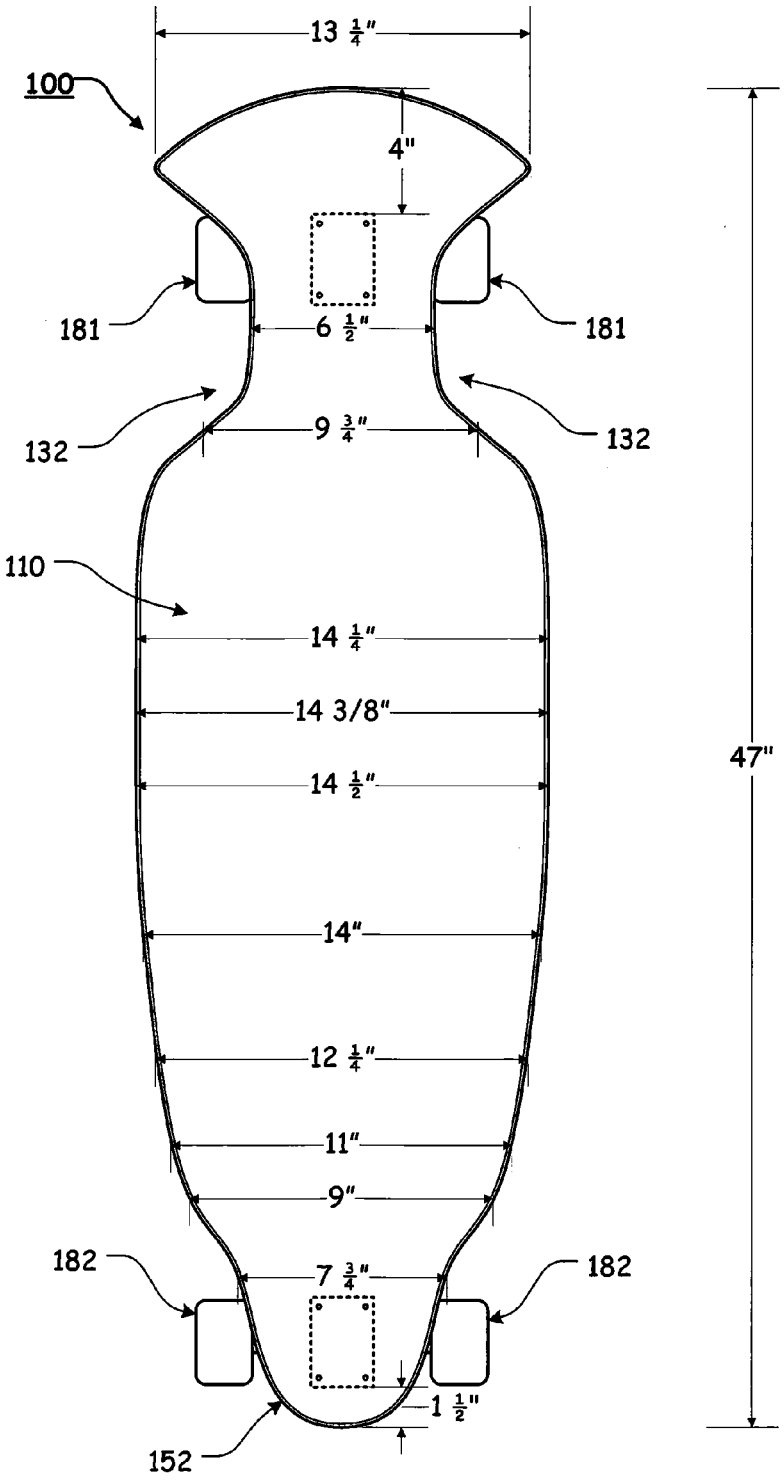
FIG. 9 shows a top view of an exemplary embodiment of a paddle skate, showing optional dimensioning, according to this invention.

While FIG. 9 shows certain exemplary, nonlimiting dimensions for the various components of the deck 110, it should be understood that the overall size and shape of the deck 110, and the various portions thereof, is a design choice based upon the desired functionality, strength, and/or appearance of the deck 110 and/or the paddle skate 100.

Figure 6:
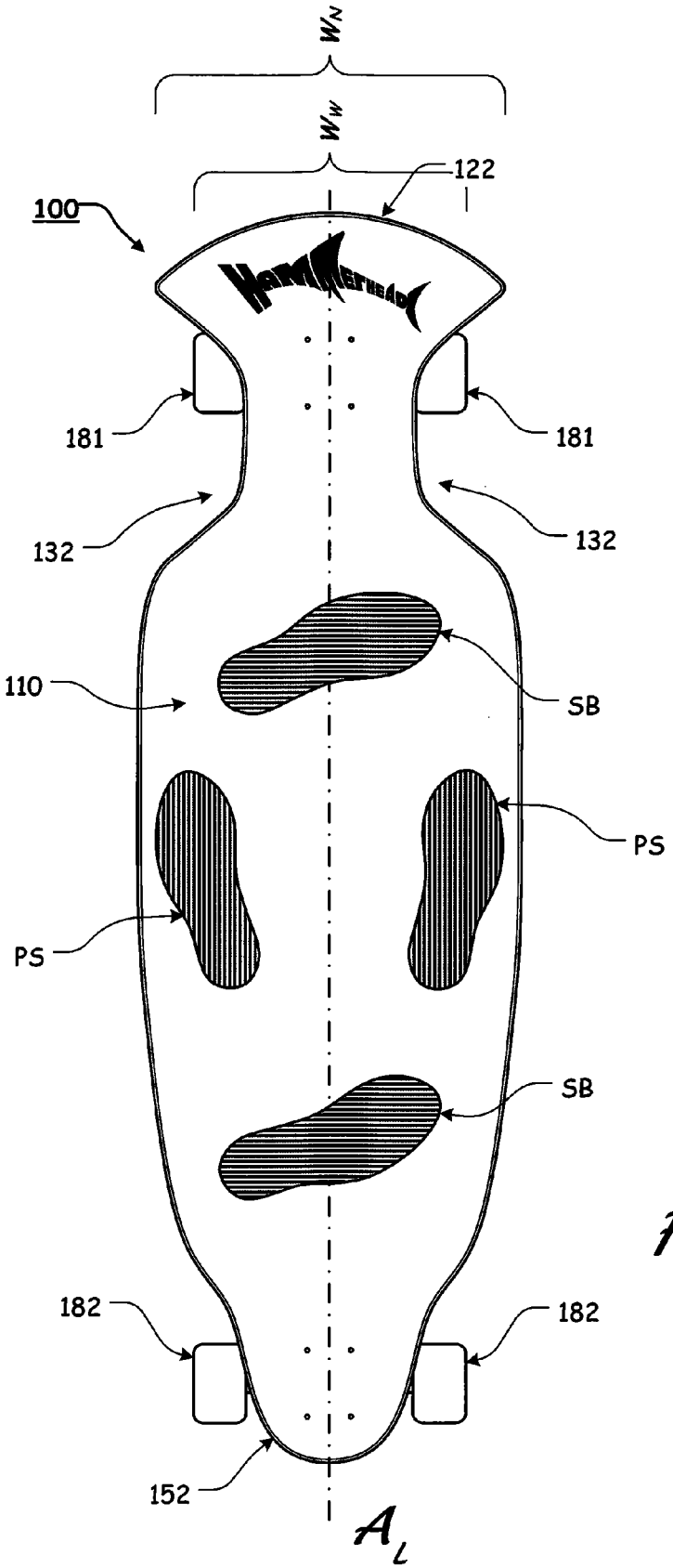
FIG. 6 shows an additional top view of an exemplary embodiment of a paddle skate, according to this invention.

For example, the width of the various portions of the deck 110 may vary based upon the amount of ground clearance provided by the selected front wheels 181 and rear wheels 182, the height of selected trucks 171 and 172, and the height of any included riser 175. The width of the central portion 140 of the deck 110 should be wide enough to allow a rider to stand on the deck 110 of the paddle skate 100 with their feet centered below their hips, toes pointed forward (substantially in line with the longitudinal axis of the paddleboard), shoulder width apart, as illustrated by foot position PS, as shown in FIG. 6. This is in contrast to the much more narrow foot position SB, provided by normal skateboards.

In certain exemplary, nonlimiting embodiments, the deck 110 is substantially planar. Alternatively, certain portions of the deck 110 may curve upward to enhance the rigidity, functionality, or anesthetics of the paddle skate 100.

The nose portion 120 is a radiused nose portion 122 that is shaped so as to form a convex curve. By design, a width $W_N$ of the radiused nose portion 122 is greater than a width $W_W$ of an attached set of front wheels 181.

Figure 7:
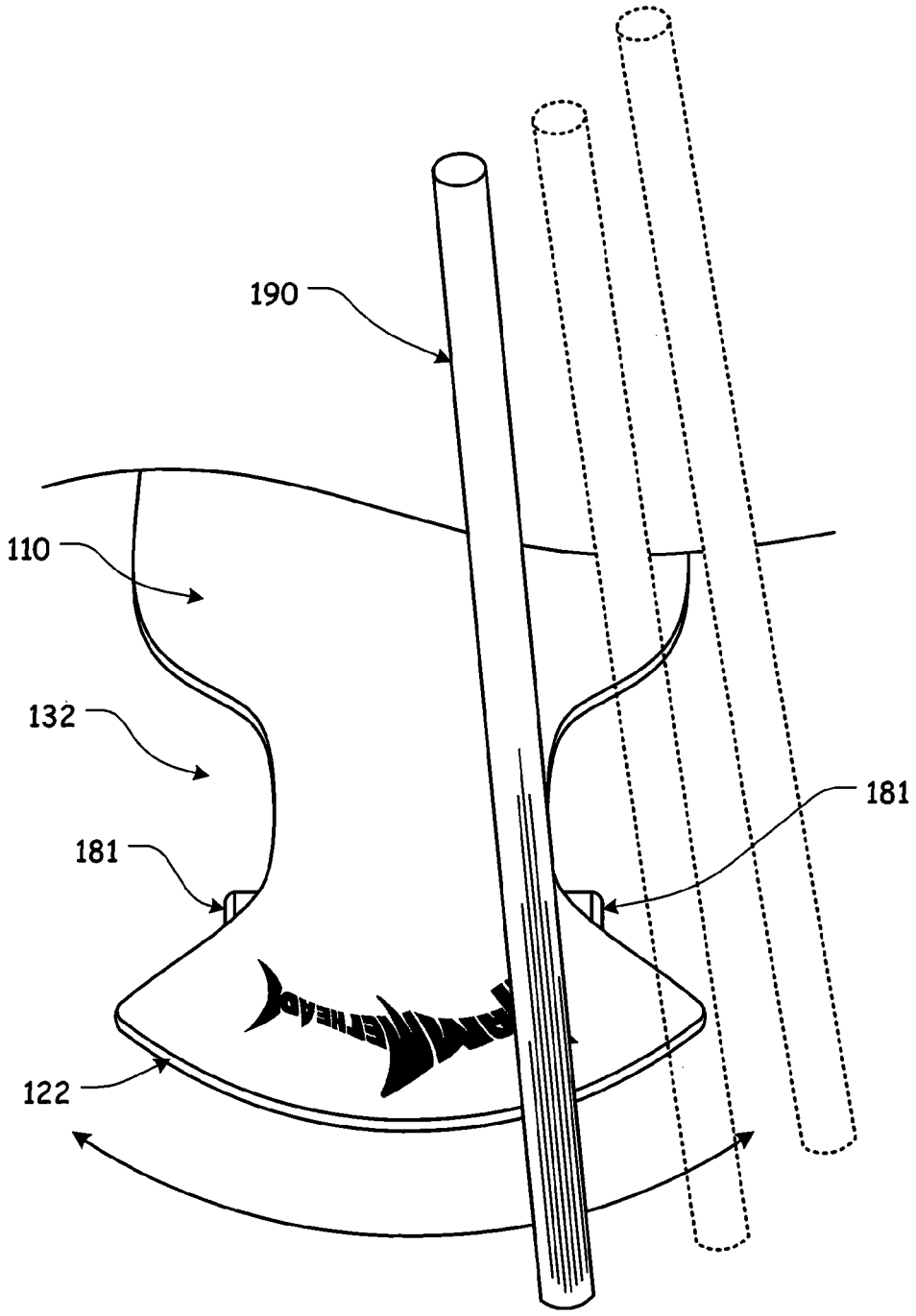
FIG. 7 shows a partial top perspective view illustrating the radiused nose portion of a paddle skate, according to this invention.

As illustrated in FIG. 7, the radiused nose portion 122 will guide or force items, and, in particular, the associate paddle/pole 190 away from the attached set of front wheels 181. Therefore, because the width $W_N$ of the radiused nose portion 122 is greater than a width $W_W$ of an attached set of front wheels 181, if the paddle/pole 190 contacts any portion of the radiused nose portion 122, the radiused nose portion 122 will force the paddle/pole 190 to one side or the other, and away from the front wheels 181.

The narrowed portion 130 is disposed between the nose portion 120 and the central portion 140 of the paddle skate 100. The narrowed portion 130 is formed of two opposed recessed areas 132 and provides an area for the front wheels 181 to enter when an attached truck 171 flexes, during turning of the paddle skate 100. In this manner, the front wheels 181 do not contact a bottom of the paddle skate deck 110, even during extreme turning maneuvers.

In various exemplary embodiments, the recessed areas 132 may comprise a dished portion that is generally "U" shaped or keyway shaped. However, it should be understood that, for simplicity and clarification, the various exemplary, nonlimiting embodiments of the paddle skate 100 are shown and/or described with reference to recessed areas 132 having a relatively "U" shaped profile. However, the generally "U" shaped profile of the recessed areas 132 is intended to be illustrative, not limiting the profile or geometry of the recessed areas 132 to any particular shape. It should be understood that the overall profile and/or geometry of the recessed areas 132 may comprise any overall profile or geometry, including, for example, a generally concave, circular, semicircular, square, rectangle, triangular, pentangular, circular, oval, elliptical, elliptical torus, star, or other shape. It should also be appreciated that the size, shape, and dimensioning of the recessed areas 132 may be dictated, in part, by the size of the selected front wheels 181, the height of selected trucks 171 and 172, and the height of any included riser 175.

Thus, it should be appreciated that the actual size, shape, profile, geometry, and dimensioning of the recessed areas 132 of the paddle skate 100 of this invention is a design choice based on the desired appearance, strength, and/or functionality of the paddle skate 100.

The tail portion 150 extends from the central portion 140 to a radiused tail portion 152. A width of the radiused tail portion 152 is less than a width of the central portion 140 and the radiused tail portion 152 is shaped so as to form a generally convex curve.

As illustrated, when the deck 110 is divided along a longitudinal axis $A_L$, a left side of the deck 110 is a substantial mirror image of a right side of the deck 110.

The first truck 171 is attached or coupled to a bottom of the deck 110 at a first location and a second truck 172 is attached to the bottom of the deck 110 at a location spaced apart from the first location. In certain embodiments, the first truck 171 is attached or coupled to the bottom of the deck 110 within the narrowed portion 130 and the second truck 172 is attached or coupled to the bottom of the deck 110 within the tail portion 150.

In certain exemplary embodiments, the second truck 172 is mounted such that the rear wheels 182 are positioned upward or backward, from the extreme distance at the radiused tail portion 152 of the deck 110 to varying distances toward the front of the deck 110 (i.e., approximately 1 to 1.5 feet from the back). By extending the tail portion 150, the rear wheels 182 are able to deflect at a greater angle without rubbing against the deck 110, providing improved turning performance for the paddle skate 100. This also allows the rider to pivot the entire paddle skate 100 upward by placing more weight on a back foot, lifting the front wheels 181, and pivoting toward the left or right, thus providing an improved turning radius in a short space or travel distance.

The wheels 181 and 182 can be any known or later developed wheels between about 48 mm and 80 mm in diameter and can either be wide or slim wheels. In certain exemplary embodiments, the trucks 171 and 172 and wheels 181 and 182 can be larger trucks and wheels, like those typically used for off-road skateboarding.

Figure 8:
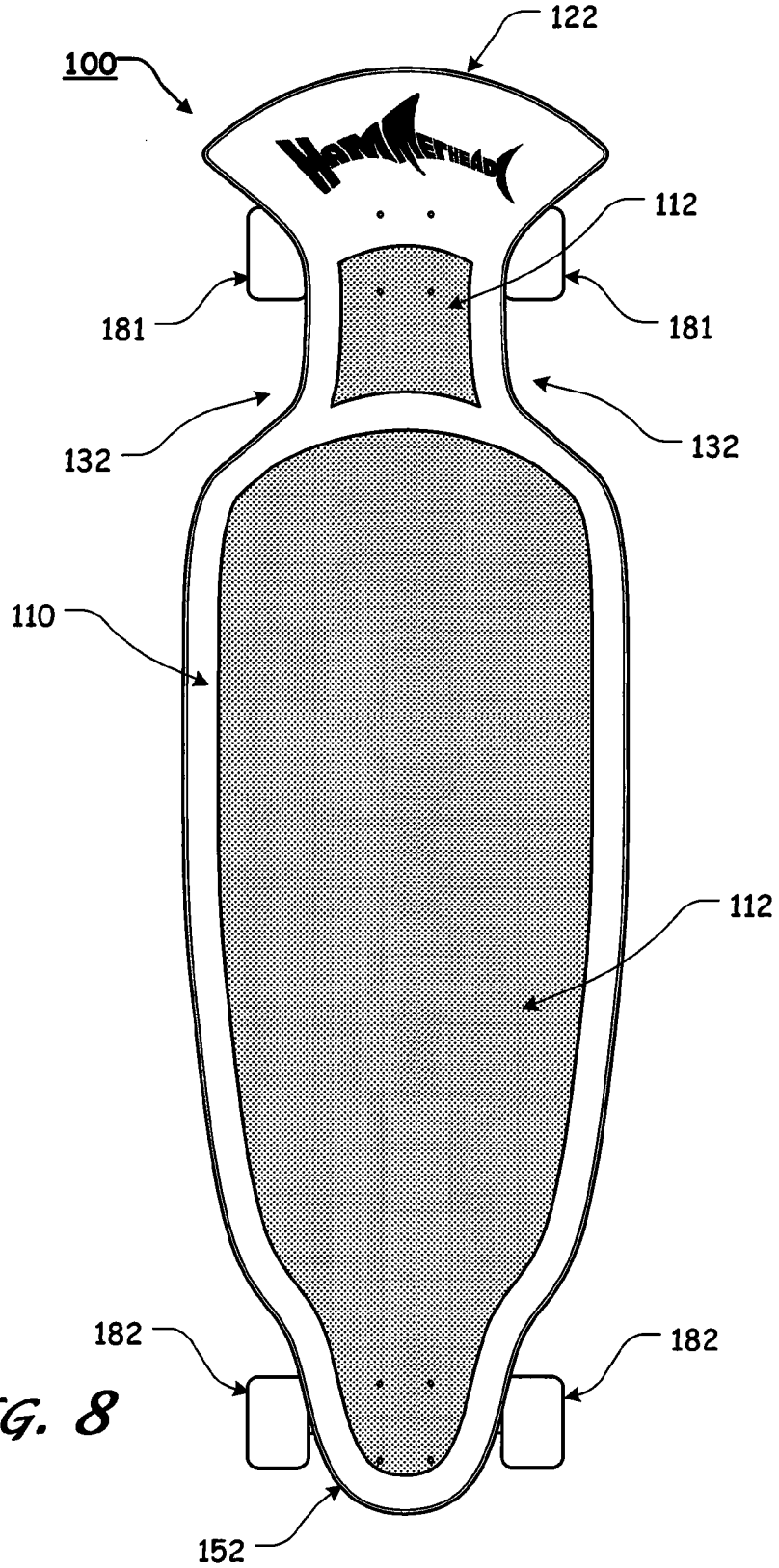
FIG. 8 shows a top view of an additional exemplary embodiment of a paddle skate, according to this invention.

FIG. 8 shows an embodiment of the paddle skate 100 wherein various portions of surface preparations 112 are removably or permanently applied to a top surface of the deck 110. In various exemplary embodiments, the surface preparations 112 comprise textured materials, such as grip tape or rubber, which allow the user to establish a more secure grip or purchase on portions of the deck 110.

It should be appreciated that the considerations for determining the appropriate size and placement of the trucks 171 and 172, the optional use of risers 175, the diameter and material of construction of the wheels 181 and 182, and the optional use of surface preparations 112, that will be utilized in conjunction with the deck 110 will be understood and apparent to those skilled in the art.

It should also be appreciated that a more detailed explanation of the specific paddle/pole 190, trucks 171 and 172, risers 175, and wheels 181 and 182 used for the paddle skate 100, instructions regarding how to attach the various components and use the paddle skate 100, and certain other items and/or techniques necessary for the implementation and/or operation of the various exemplary embodiments of the present invention are not provided herein because such elements are commercially available and/or such background information will be known to the user. Therefore, it is believed that the level of description provided herein is sufficient to enable one of ordinary skill in the art to understand, assemble (if necessary), and practice the invention, as described.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A skateboard element, comprising:

an elongate deck extending from a nose portion to a tail portion and having a narrowed portion and a central portion disposed between said nose portion to said tail portion;

wherein said nose portion is a radiused nose portion;

wherein said radiused nose portion forms a convex curve;

wherein said radiused nose portion is radiused so as to guide items contacting said radiused nose away from an attached set of wheels; and wherein said narrowed portion is disposed between said nose portion and said central portion.

2. The skateboard element of claim 1, wherein said tail portion is a radiused tail portion.

3. The skateboard element of claim 1, wherein said deck is substantially planar.

4. The skateboard element of claim 1, wherein a left side of said deck is a substantial mirror image of a right side of said deck, when said deck is divided along a longitudinal axis of said deck.

5. The skateboard element of claim 1, wherein said narrowed portion allows an attached truck to flex without an attached wheel contacting said deck.

6. The skateboard element of claim 1, wherein a width of said radiused nose portion is greater than a width of an attached set of wheels.

7. The skateboard element of claim 1, wherein a width of said radiused nose portion is greater than a width of said narrowed portion.

8. The skateboard element of claim 1, wherein a width of said narrowed portion is less than a width of said central portion.

9. A skateboard element, comprising:

an elongate deck extending from a nose portion to a narrowed portion, and from said narrowed portion to a central portion, and from said central portion to a tail portion;

wherein said nose portion is a radiused nose portion;

wherein said radiused nose portion forms a convex curve;

wherein said radiused nose portion is radiused so as to guide items contacting said radiused nose away from an attached set of wheels; and wherein said narrowed portion is formed of two opposed recessed areas.

10. The skateboard element of claim 9, wherein said tail portion is a radiused tail portion.

11. The skateboard element of claim 9, wherein said deck is substantially planar.

12. The skateboard element of claim 9, wherein a left side of said deck is a substantial mirror image of a right side of said deck, when said deck is divided along a longitudinal axis of said deck.

13. The skateboard element of claim 9, wherein said narrowed portion allows an attached truck to flex without an attached wheel contacting said deck.

14. The skateboard element of claim 9, wherein a width of said radiused nose portion is greater than a width of an attached set of wheels.

15. The skateboard element of claim 9, wherein a width of said radiused nose portion is greater than a width of said narrowed portion.

16. The skateboard element of claim 9, wherein a width of said narrowed portion is less than a width of said central portion.

17. A paddle skate, comprising:

an elongate deck extending from a nose portion to a narrowed portion, and from said narrowed portion to a central portion, and from said central portion to a tail portion;

wherein said nose portion is a radiused nose portion;

wherein said radiused nose portion forms a convex curve;

wherein said radiused nose portion is radiused so as to guide items contacting said radiused nose away from an attached set of wheels;

wherein said narrowed portion is formed of two opposed recessed areas;

a first truck attached or coupled to a bottom of said deck at a first location; and a second truck attached to said bottom of said deck at a location spaced apart from said first location.

18. The skateboard element of claim 17, wherein said first truck is attached or coupled to said bottom of said deck within said narrowed portion and wherein said second truck is attached or coupled to said bottom of said deck within said tail portion.

* * * * *